US007913812B2

(12) United States Patent
Sanders

(10) Patent No.: US 7,913,812 B2
(45) Date of Patent: Mar. 29, 2011

(54) COMPOSITE SOUND BARRIER PANEL

(76) Inventor: Mark Sanders, Zionsville, IN (US)

( * ) Notice: Subject to any disclaimer, the term of this patent is extended or adjusted under 35 U.S.C. 154(b) by 195 days.

(21) Appl. No.: 11/842,718

(22) Filed: Aug. 21, 2007

(65) Prior Publication Data

US 2009/0050401 A1 Feb. 26, 2009

(51) Int. Cl.
*E04B 1/82* (2006.01)
*E04H 17/00* (2006.01)
*B32B 21/04* (2006.01)

(52) U.S. Cl. ..... 181/290; 181/210; 52/144; 428/537.1

(58) Field of Classification Search ..... 181/290, 181/210, 141; 52/144; 428/537.1
See application file for complete search history.

(56) References Cited

U.S. PATENT DOCUMENTS

| | | | | |
|---|---|---|---|---|
| 3,625,808 | A * | 12/1971 | Martin | 428/68 |
| 4,325,457 | A * | 4/1982 | Docherty et al. | 181/210 |
| 4,513,040 | A * | 4/1985 | Lankard | 428/49 |
| 4,607,466 | A * | 8/1986 | Allred | 52/144 |
| 5,678,363 | A * | 10/1997 | Ogorchock et al. | 52/144 |
| 6,827,179 | B2 * | 12/2004 | Drake et al. | 181/290 |
| 2003/0097806 | A1 * | 5/2003 | Brown | 52/220.1 |
| 2006/0048997 | A1 * | 3/2006 | Foster et al. | 181/285 |
| 2006/0188740 | A1 * | 8/2006 | Kuan | 428/537.1 |
| 2007/0137139 | A1 * | 6/2007 | Tierney et al. | 52/748.1 |

* cited by examiner

*Primary Examiner* — Elvin G Enad
*Assistant Examiner* — Christina Russell
(74) *Attorney, Agent, or Firm* — Maginot, Moore & Beck LLP

(57) ABSTRACT

A composite sound barrier panel includes a concrete substrate provided for strength and a noise attenuation layer bonded thereto. The noise attenuation layer in one embodiment is a concrete mixture of a fiber composite material and cement. In another embodiment, recycled wood chips are added to the mixture. A plurality of identical panels are pre-cast in a mold for use in forming a noise abatement wall, particularly between a residential neighborhood and a highway.

6 Claims, 1 Drawing Sheet

COMPOSITE SOUND BARRIER PANEL

BACKGROUND

The present invention relates to sound barriers, such as sound-absorbing walls.

In recent years, state highway commissions or transportation departments have promulgated noise level standards for highways passing through urban neighborhoods. As population densities in urban areas increase, it is a virtual certainty that residential neighborhoods will be adjacent a high speed throughway. Even in suburban areas, the desire for ready access to highways and interstates prompts residential development in close proximity to these roads.

Highway noise can greatly impact quality of life for the nearby residents. The federal Environmental Protection Agency has determined that noise levels above 66 decibels are unsafe for residential areas, while 72 dB is the limit for commercial environments. It has been suggested that high decibel levels along the highways may be linked to hearing loss, high blood pressure, irritability, ulcers, and heartburn, among other ailments. A standard pickup truck at 50 mph produces noise at 70 dB, while a medium truck is twice as loud at 80 dB. A motorcycle can reach 90 dB, which is four times louder than the pickup truck.

Highway noise is not only a function of the inherent noisiness of each vehicle. For instance, highway noise doubles when the traffic increases from 200 vehicles per hour to 2000 vehicles per hour, or when traffic speed increases from 30 mph to 65 mph. A single semi-trailer truck at 55 mph produces as much noise as ten cars at the same speed. It is not hard to see that highway noise in densely populated urban environments can quickly become unbearable.

Many approaches have been devised to address the problem of road noise. Some noise abatement systems involve designing the roads themselves to reduce vehicle noise. Lower highway speed limits within city limits can reduce noise. For new development, buffer zones are provided between the residential or commercial buildings and the highway. But for many older neighborhoods, traffic volume has steadily increased over the years as the traffic flow on the adjacent roads has increased. For these neighborhoods, sound barriers are the most viable solution.

Effective noise abatement systems can reduce sound levels 10-15 dB, cutting the loudness of the traffic in half. Where space permits, earth barriers are relative inexpensive and can be used to improve the ecological aesthetics of the neighborhood. This approach is common for new neighborhoods but not often available for existing residential areas. Walls, on the other hand, take up less space. Generally, such walls are limited to 25 feet in height for structural and aesthetic reasons. Noise walls may be built from wood, stucco, concrete, masonry, metal and similar materials.

Concrete sound barrier walls are frequently used because they require only minimal continuing upkeep and are very weather resistant. Moreover, the ability to produce pre-fabricated concrete panels can simplify construction, while also providing the ability to add aesthetic features to the panels.

DESCRIPTION OF THE EMBODIMENTS

Figure 1:
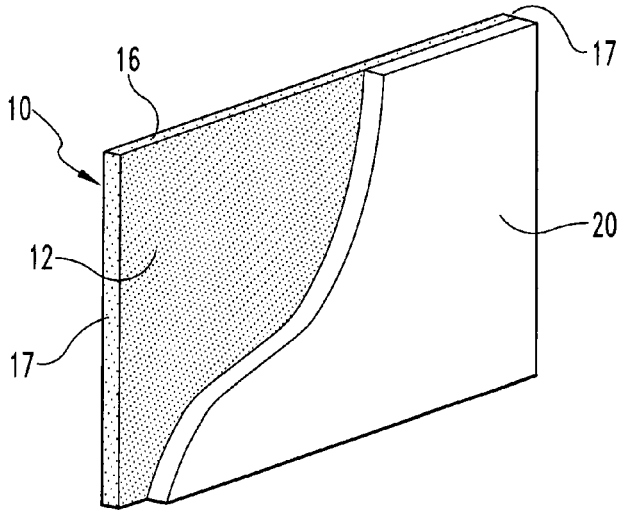
FIG. 1 is a perspective view of a composite sound barrier panel according to one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
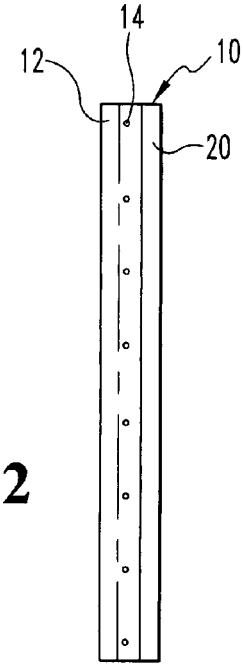
FIG. 2 is an end view of the composite panel shown in FIG. 1.

According to one aspect of the invention, a composite sound barrier panel 10 includes a substrate 12 and a noise attenuation layer 20, as shown in FIGS. 1 and 2. The substrate 12 is preferably a pre-formed or pre-molded concrete panel. The substrate may include reinforcing members 14 throughout the panel, such as rebar or wire mesh. The substrate 12 may incorporate various known elements for lifting the panel 10, for interconnecting panels or for supporting the panel at the job site, all as dictated by the particular needs. For instance, lifting bolt threaded inserts may be provided at the top edge 16 of the substrate 12 for engagement with lifting cables. The lateral edges 17 may be formed as lap joints or in some other interlocking configuration to integrate with an adjacent panel. Alternatively, connector plates may be embedded in the lateral edges 17. It is contemplated that the substrate 12 can be formed according to the design of the particular noise abatement system.

In a further aspect of the invention, the noise attenuation layer 20 is formed from a combination of concrete with a fiber composite filler. The fiber composite filler is preferably fiberglass, and most preferably waste fiberglass. The use of waste fiberglass recycles a hazardous waste material. In addition, the use of waste fiberglass significantly reduces the cost of the panel 10 since the cost of the waste material from a reclamation company is significantly lower than the cost of a pre-manufactured fiberglass panel.

In the preferred embodiment, the noise attenuation layer 20 is formed from 2½ parts fiber composite material, 1 part cement and ½ part water. The cement is preferably Lehigh Type 1 or equivalent. The fiber composite material, or fiberglass, is shredded so that it can be mixed with the cement and water. These constituents are thoroughly mixed and poured into a mold corresponding to the desired shape of the panel. The mold face may incorporate structural and/or design features as dictated by the design of the noise abatement system. It is contemplated in a most preferred embodiment that the noise attenuation layer 20 is not a load bearing component of the panel, so reinforcement elements are not essential. If desired, a thin layer of cement may be initially poured, followed immediately by the noise attenuation layer. This thin layer will hide any fiber composite that may reside at the surface of noise attenuation layer. Pouring the noise attenuation layer immediately after the initial concrete layer will allow the two layers to merge together.

Shortly after the noise attenuation layer has been poured, and well before the cement in that layer has set, the concrete substrate 12 may be poured. Pouring this substrate layer while the reduction layer is fresh will allow the materials to commingle and firmly bond together once the concrete has set. The pour for the substrate can proceed according to known concrete panel fabrication techniques, especially where reinforcement elements 14 or other structural/functional elements are to be incorporated into the substrate. The substrate may have a higher slump than the noise attenuation layer to maintain the integrity of the two parts of the panel 10.

The panels 10 have a height and length that is determined by the needs at the job site. The thickness of the substrate 12 will preferably range from 4-6 inches, with a most preferred thickness of 4½ inches. The thickness of the noise attenuation layer 20 can be sized according to the desired noise attenuation characteristics of the layer. This thickness will typically range from 2-5 inches.

Figure 3:
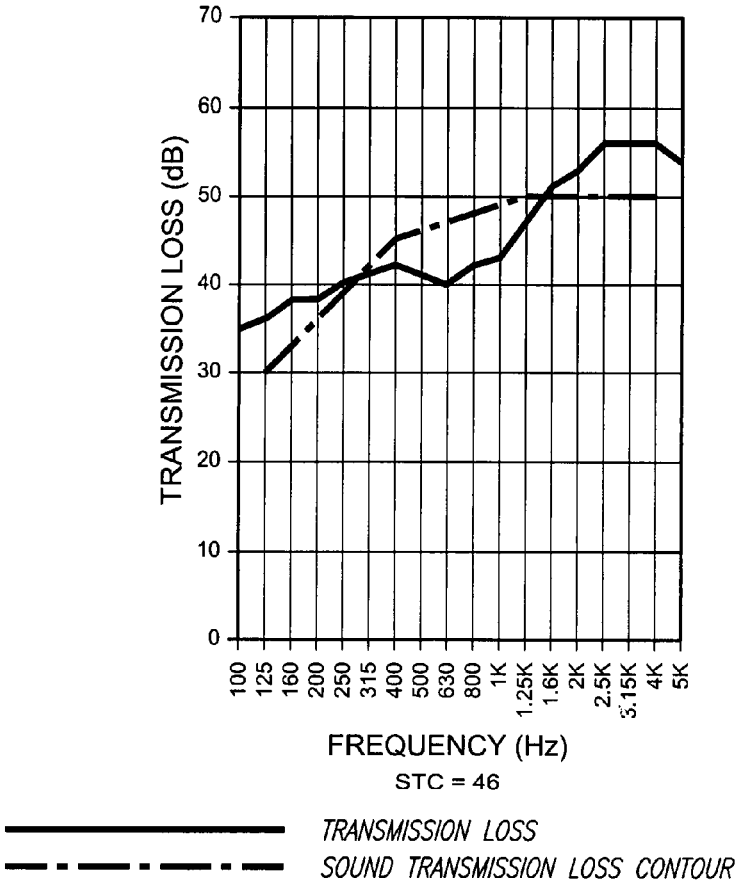
FIG. 3 is a sound transmission loss graph for an exemplary composite panel fabricated according to the present invention.

In one specific example, a panel was fabricated with a 5¼ inch thick substrate and a 3 inch thick noise attenuation. The sound transmission loss curve for this specimen is shown in FIG. 3. The transmission loss values correspond to the reduction in sound decibels from one side of the panel to the other. This specimen produced an STC of 46 and an OITC of 41. The latter number is generally accepted to be more appropriate with respect to road noise because it is based on transmission loss values down to 80 Hz, rather than the 125 Hz weighting of the STC number. In the context of room walls, an OITC number of 41 means that loud speech and music from an adjacent room can be easily heard. TC numbers above 40 are very well suited for road noise attenuation barriers. It can be noted from the graph in FIG. 3 that the tested panel provided transmission losses of 35-40 dB in the lower frequency range where the majority of the road noise resides. Thus, if a truck generates 80 dB noise, the panels of the present invention will reduce the transmitted noise by at least 35 dB, to about 45 dB which is about as loud as an air conditioning unit.

Further testing of the specimen panel verified the weather resistance of the composite construction. These tests include surface burning, exposure to deicing chemicals and rapid freeze-thaw. Of course, the performance of any particular composite panel constructed according to the present invention will depend upon the quality of the concrete mixture. However, the specimen testing established that the composite construction of the panels 10 of the present invention are no more susceptible to environmental effects than a concrete road surface.

In accordance with the present invention, the concrete substrate 12 may be modified as desired for particular considerations, such as strength, cost, weather resistance, aesthetics and the like. Thus, additives may be combined with the cement used to form the concrete substrate, such as plasticizers, sealants and pigments. Some variation in the materials of the noise attenuation layer 20 may be acceptable, although significant modifications may compromise the sound transmission loss performance of the panel. It is therefore preferred that any materials added the noise attenuation layer have sufficient sound absorption qualities.

For instance, in one modified embodiment, wood chips are added to the fiberglass and cement. Preferably, the wood chips are ¼-1½ inches in length and no more than about ¼ inches thick. The wood chips are most preferably recycled from wood products that have been comminuted. In this embodiment, the wood chips are combined in the concrete mixture according to the following formula: 2 parts wood chips, 1 part fiberglass, 1 part cement and ½ part water. The concrete mixture is prepared according to known techniques to form the noise attenuation layer 20. Since the layer 20 is not intended for load bearing, the volume ratio of additives to cement can be much higher than other concrete additives, hence the ability to incorporate not only fiberglass but also woodchips in the concrete mixture. In this circumstance, the cement operates as a binder between the additives as well as between the noise abatement layer 20 and the load bearing concrete substrate 12.

One aspect of the panel 10 of the present invention is that it can be easily precast at a manufacturing facility remote from the installation site. A number of identical molds may be used to produce a quantity of uniform panels, or a single mold may be used to produce a length of panel that is cut to size. The precast panels may formed in fixed molds, by slip-forming, or by other known techniques for fabricating pre-cast concrete panels.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, in the preferred embodiment, the concrete substrate 12 is poured onto the noise abatement layer 20 so that the two layers commingle or physically bond. Alternatively, each segment of the composite panel may be separately formed and cured, and then chemically bonded with a suitable adhesive material, such as concrete adhesive, epoxy and mortar.

What is claimed is:

1. A sound barrier panel, comprising:

a concrete substrate;

a noise attenuation layer formed of a concrete-forming cement and fiber composite material mixture; and a cement layer covering said noise attenuation layer said cement layer being relatively thin relative to said noise attenuation layer or said concrete substrate, said cement layer, said noise attenuation layer and said concrete substrate combined to form a composite panel, wherein said concrete substrate is physically bonded to said noise attenuation layer by pouring the concrete substrate onto the noise attenuation layer before said layer has set and commingling the concrete substrate with the noise attenuation layer where the concrete substrate consequently contacts the noise attenuation layer.

2. The sound barrier panel of claim 1, wherein said fiber composite material is fiberglass.

3. The sound barrier panel of claim 2, wherein the fiberglass is recycled.

4. The sound barrier panel of claim 1, wherein said noise attenuation layer further includes wood chips.

5. The sound barrier panel of claim 1, wherein said concrete substrate includes reinforcing elements.

6. The sound barrier panel of claim 1, wherein said noise attenuation layer is physically bonded to said cement layer by pouring the noise attenuation layer onto the cement layer before the cement layer has set.

* * * * *